United States Patent [19]

Scott

[11] 4,068,826

[45] Jan. 17, 1978

[54] HEAVY DUTY LIFTING DEVICES

[76] Inventor: Leroy A. Scott, R.R. No. 6, Paola, Kans. 66071

[21] Appl. No.: 817,578

[22] Filed: July 21, 1977

[51] Int. Cl.[2] ..... B66F 7/28

[52] U.S. Cl. ..... 254/134

[58] Field of Search ..... 254/133, 134, DIG. 1

[56] References Cited

U.S. PATENT DOCUMENTS

| | | | |
|---|---|---|---|
| 1,292,823 | 1/1919 | Livesay | 254/133 R |
| 1,505,443 | 8/1924 | Stone | 254/134 |
| 2,314,589 | 3/1943 | Mandl | 254/134 |
| 2,852,229 | 9/1958 | Gross | 254/134 |

*Primary Examiner*—Robert C. Watson

*Attorney, Agent, or Firm*—Thomas M. Scofield

[57] ABSTRACT

Improvements in heavy duty hydraulic jacks; heavy duty hydraulic jack sleeves which are provided with a plurality of engagement positions for the hydraulic piston rod operative to permit a greater extension of the load carrying sleeve with respect to the base of the jack than the throw of the hydraulic cylinder.

7 Claims, 4 Drawing Figures

HEAVY DUTY LIFTING DEVICES

BACKGROUND OF THE INVENTION

Many hydraulic jack and air piston devices for lifting are known commercially and in the prior art. The below-listed Patents are typical of these devices. However, they have shortcomings for certain purposes.

In farm and commercial use, often there is available a tractor with hydraulic cylinders and a source of hydraulic energy and power. In such farm and commercial use, there are quite often heavy lifting problems, including, for example, the tractor itself if one of its large tires should blow out. In such case, it may cost $30 or more for a farmer to hire an appropriate professional to come to his farm, jack up the tractor, remove the wheel and take it for repair. Alternatively, if he can remove the tire and get it into town, the cost for repair of the tire is far less.

There exists now a definite need for a heavy duty, dependable jack useable in such circumstances and to lift other heavy objects, such as houses, grain bins and the like, for leveling. In such heavy duty use, it is eminently desirable, indeed necessary, that the jack construction be such that no part of the jack will twist with respect to another part or rotate under heavy load conditions. Yet further, a particular problem lies in the fact that all conventional hydraulic cylinders (or air pistons) have a limited throw with respect to their own size. In order to have the greatest versatility in a heavy duty jack, then, means must be provided to permit the maximum feasible throw of the load carrying sleeve with respect to the supporting post (the male-female elements of the jack), independent of limitations of the throw of the hydraulic cylinder or air piston. In such case, it is necessary to provide means for securing the movable part of the jack with respect to the stationary part whenever adjustments with respect to engagement with the hydraulic cylinder or air piston are made. These considerations lie as the basis for the development of the subject improved heavy duty tractor and implement jack.

BRIEF DESCRIPTION OF THE INVENTION

The device in question is made up of four parts, specifically: (1) a base plate with a rigid, rectangular section post secured at one end thereto; (2) a congruent sleeve fitting over and movable with respect to the post and (3) the power means for moving the sleeve with respect to the base plate and post, here specifically considered as a tractor hydraulic cylinder, other conventional hydraulic cylinder or an air piston. (4) Means must be additionally provided to permit engagement of the cylinder or piston rod with the movable sleeve at different positions along its length to enable versatility of use (in the sense that the translation of the sleeve with respect to the base post can start from different positions along the length of the base post). In the subject device, this is permitted by the provision of two or more slideways mounted on the movable sleeve or movable element of the jack, alternate ones of the slideways being engaged by a slide which has a lug for engagement by the connecting bracket attached to the cylinder or piston rod of the hydraulic cylinder or air piston.

THE PRIOR ART

Applicant is aware of the following Patents directed to various jack constructions:

Paoli U.S. Pat. No. 1,455,223, issued May 15, 1923 for "Hydraulic Jack";

Templeton et al U.S. Pat. No. 1,727,914, issued Sept. 10, 1929 for "Expanding Tool";

Nilson U.S. Pat. No. 2,131,815, issued Oct. 4, 1938 for "Fluid Operated Power Device";

Solomon U.S. Pat. No. 2,365,151, issued Dec. 19, 1944 for "Power Apparatus For Aligning Work"; and Gross U.S. Pat. No. 2,852,229, issued Sept. 16, 1958 for "Lifting Equipment For Jack Operation".

OBJECTS OF THE INVENTION

A first object of the invention is to provide an improved tractor and implement jack construction driven by an hydraulic cylinder, which is of great simplicity, utility, strength and power.

Another object of the invention is to provide an improved jack construction which is particularly adapted to take advantage of and be useable with a conventional tractor hydraulic cylinder.

Another object of the invention is to provide an hydraulic cylinder operated jack construction of improved character which may be used in the heaviest work applications, for automotive, farm and commercial work, where lift means are provided of great simplicity and great strength, same operative to obtain and utilize the maximum working throw of the elements of the jack within the working parameters of the throw of the piston rod of the hydraulic cylinder and the safe engagement of the male and female elements (post and sleeve) of the jack.

Yet another object of the invention is to provide an improved tractor and implement jack construction, where the post and sleeve of the jack are of rectangular or (optimally) square cross-section, whereby all of the operative elements of the jack are particularly oriented and function with respect to particular sides or faces of the square or rectangular post and sleeve. Further, this configuration of the parts provides very great strength and stability with respect to the operation of all parts of the jack.

Other and further objects of the invention will appear in the course of the following description thereof.

DESCRIPTION OF THE DRAWINGS

In the drawings, which form a part of the instant specification are to be read in conjunction therewith, an embodiment of the invention is shown and, in the various views, like numerals are employed to indicate like parts.

STRUCTURE AND FUNCTION

Figure 1:
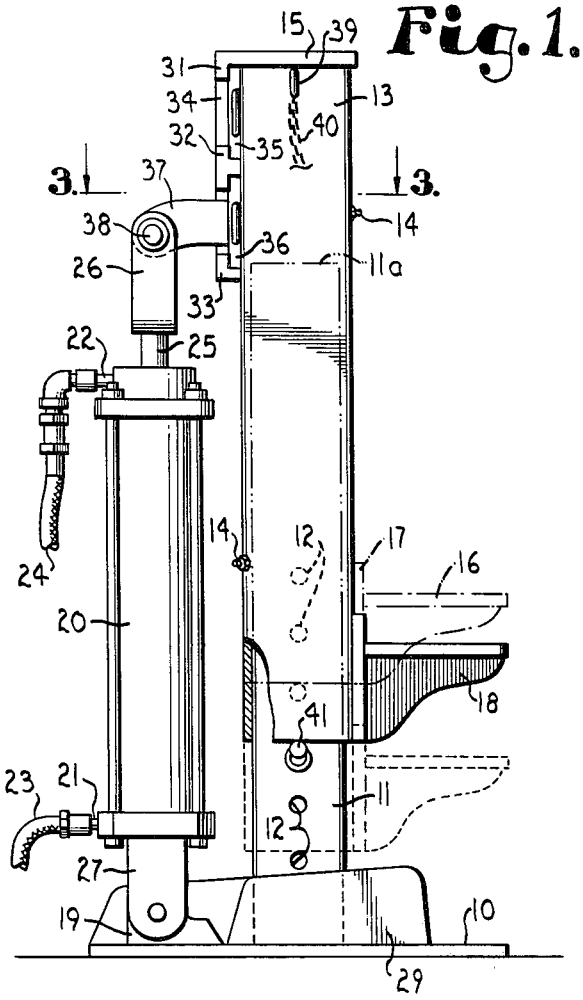
FIG. 1 is a side view of the subject device showing the slide or sleeve somewhat elevated on the post of the jack, the sleeve being supported in its elevated position on the post by a pin inserted in one of the lowermost openings in the post. The working slide (carrying the lug engaging the piston rod of the hydraulic cylinder) is positioned in the lower slideway or slot on the sleeve, whereby to attain the maximum throw of the slide or the sleeve with respect to the jack base plate. A part of the sleeve is cut away in the lower portion thereof to better illustrate the construction. The dotted line showings are the upper and lower positions of the lower end of the sleeve when the working slide is positioned in the upper slideway.
Figure 2:
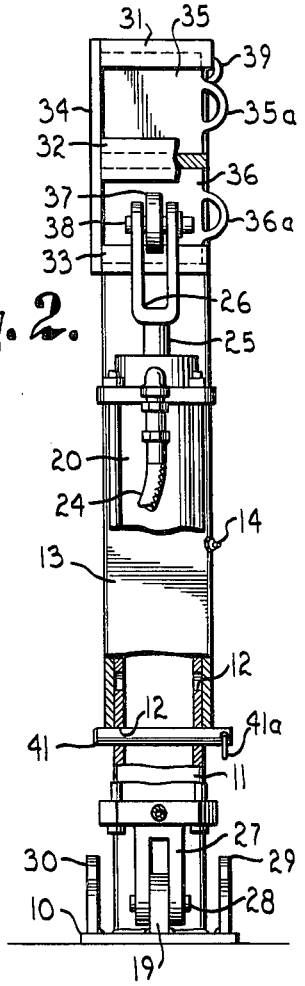
FIG. 2 is a view taken from the left hand side of FIG. 1, looking to the right in the view of FIG. 1, with parts cut away in the view to better illustrate various portions of the structure.
Figure 3:
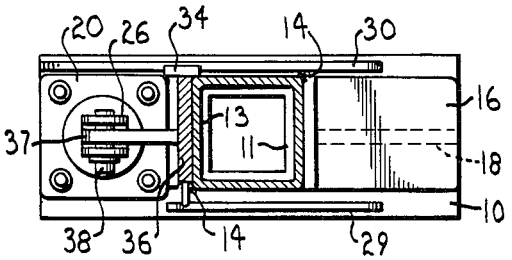
FIG. 3 is a view taken along the line 3—3 of FIG. 1 in direction of the arrows.

Referring to the drawings, and particularly to FIGS. 1–3, inclusive, a substantially rectangular, preferably steel base plate 10 supports the subject jack construction for use. Mounted substantially centrally upon base plate 10 is an elongate, normally vertical, preferably hollow post 11. Normally vertical post 11 is positioned normal or at right angles to normally horizontal plate 10 and is preferably of rectangular horizontal section, optimally square horizontal section. The upper end 11*a* of post 11 may be closed by a top sealing plate, if desired, but may conveniently be left open. A plurality of equal spaced, paired openings 12 are provided through the opposed, parallel side walls of post 11, centrally thereof, as seen in FIGS. 1 and 2.

An elongate, hollow sleeve 13 is provided which is of congruent internal configuration to the outside wall configuration of post 11. That is, if the latter is rectangular in horizontal section, so is slide 13. The fit is a sliding one, preferably with a minimum clearance. One or more grease fittings 14 may be provided along the length of sleeve 13 so that grease may be introduced into the annulus between sleeve 13 and post 11 for lubricating purposes. The lower end of sleeve 13 is open so that it may be fitted over post 11. The upper end thereof is closed, preferably by a flat end plate 15, plate 15 adapted to receive weight thereon. A foot or platform 16 is welded or otherwise fixedly attached to base plate 17 on one side of sleeve 11, there preferably being provided bracing plate 18 thereunder, normal to fit plate 16 and fixed at its upper edge to plate 16 and inward edge to base plate 17.

Thus the work to be raised or lifted may be received either on top of plate 15 or on platform 16, depending on its height above the ground or other surface receiving base plate 10 thereon.

Lug plate 19 is preferably fixed centrally of rectangular base plate 10, centered with respect to post 11 (which preferably also is centered on plate 10) and 90 degrees arcuately positioned from the openings 12 through post 11.

A conventional tractor hydraulic cylinder 20 (or air cylinder) has air or hydraulic inlets 21 (lower) and 22 (upper) thereon adapted to receive and connect to hydraulic or air hoses 23 and 24. The latter are connected to any suitable source of hydraulic or air pressure. Hydraulic or air piston rod 25 extends upwardly from cylinder or piston 20 and has conventional U configuration connecting or engaging bracket 26 fixed to the upper end thereof. Likewise, at the lower end of hydraulic or air cylinder or piston 20, there is provided U-shaped mounting bracket 27, the latter fixed or welded to the bottom side of piston or cylinder 20. Mounting bracket 27 is here shown pivotably connected to base lug 19 by removable pin 28. If desired, a single action cylinder may be employed.

A pair of vertical brace plates 29 and 30 are secured on base plate 10 for reinforcement purposes, both of them spaced sufficiently far away from post 11 that sleeve 13 may slide up and down the post without impedance. Brace plate 29 is relieved at its left hand end in FIGS. 1 and 3, in order to provide access to pin 28.

A pair of vertically spaced apart slideways are provided on the side of sleeve 13 opposite from that carrying foot or foot plate 16, specifically, on the side of sleeve 13 next to lug 19. The slideways may be provided as follows. In the first place, top plate 15 on sleeve 13 is extended rearwardly (on the side of lug 19) past the wall of the sleeve and downwardly angled to form a L-shaped member or flange 31. Fixed by welding or other conventional means to the same wall of sleeve 13 is a T-shaped member in side view 32. Finally, downwardly spaced therefrom and fixed to the same wall of sleeve 13 is L-shaped member 33. A plate 34 is provided fixed to slide 13 and members 31–33, inclusive which closes the slideways at one end thereof.

There are provided two slides, here numbered 35 and 36. Each of them is provided with an engaging loop 35*a* or 36*a* on one side thereof. Slide 35 is just that, without attachments for connection to the hydraulic or air piston. Slide 36, on the other hand, has an elongate member or lug 37 adapted to be engaged by pin 38, same also engageable with connector member 26 on piston cylinder rod 25. The basic purpose of slide 35 is to fill the upper slideway between members 31 and 32 when the other slide 36 is in the lower slideway (as seen in FIGS. 1–3, inclusive), in order that any thrust transmitted to sleeve 13 is transmitted through member 32 and slide 35 to upper plate 15. Said otherwise, when the slides are in the position of FIGS. 1–3, inclusive, there is a rigid structure extending from member 33 to plate 15.

An eyelet or lug 39 may be provided on sleeve 13 to which chain members 40 may be connected, same also connecting to loops or eyelets 35*a* and 36*a* so that, when slides 35 and 36 are not positioned in the slots provided for them, they will not be lost. An elongate pin 41 is provided of sufficient length to pass through openings 12 and underlie the lower end of sleeve 13. A loop 41*a* may be provided therewith so that pin 41 also may be secured to eyelet or loop 39 by suitable chain means 40. Three chains 40 may be engaged with eyelet 39, one for each slide and one for pin 41.

Figure 4:
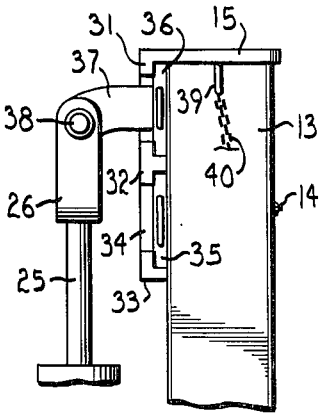
FIG. 4 is a fragmentary side view of the top of the device of FIGS. 1–3, inclusive, with the working slide positioned in the top slideway or slot on the sleeve and the piston rod of the hydraulic cylinder further extended than is seen in the views of FIGS. 1 and 2.

FIG. 4 shows the situation when slide 36, bearing lug 37 thereon, is positioned in the upper slideway immediately below plate 15. Slide 35 is positioned in the lower slideway. When the slide 36 is positioned in the upper slideway, as in FIG. 4, and the piston rod 25 is in its lowest extension as seen in FIGS. 1–3, inclusive, then, as is seen in dotted lines in FIG. 1, the lowermost edge of the sleeve 13 is positioned just above the lowermost hole 12 in post 11. The lowermost hole 12 must be above the upper edge of reinforcing brackets 29 and 30. Thus it may be seen that, when slide 36 is in either the lower or upper slideway, it is necessary to lift the sleeve 13 from its bottomed-out position upwardly to at least above the lowermost opening 12. At this point, pin 41 may be inserted to secure the vertical position of sleeve 13 on post 11 and, at the operator's leisure, slide 36 may be inserted in the lower slideway (dotted line showing of FIG. 1) and the engagement of the brackets 26 and 27 of hydraulic cylinder or air piston 20 made thereafter.

In the event that it is desired that the slide 36 be positioned in the lowermost slideway (FIGS. 1–3, inclusive), which means that the maximum height of sleeve 13 with respect to base plate 10 will be achievable with a given hydraulic cylinder or air piston, the sleeve 13 is preferaby raised to the full line position of FIGS. 1–3, inclusive for insertion of pin 41 before the connection of the brackets 26 and 27 of the cylinder or piston to the lugs 19 and 37 (or only the latter if the securement with lug 19 is retained from a previous engagement).

In use or operation, assuming that the three parts of the device are separated (base plate or post, sleeve 13 and hydraulic cylinder 20), the operator first places the base plate on the ground adjacent the work to be lifted. Either plate 15, atop sleeve 13 or foot plate 16 may later be placed under the work, depending on its relative height from the ground. The sleeve 13 is placed over post 11 and bottomed-out thereon. The internal height of the sleeve is preferably slightly less than the height of the post so that sleeve 13 bottoms-out on the post, rather than plate 10. The operator then determines whether he wishes the maximum lift of the sleeve with respect to post 11 or the lesser lift. If the latter, then the sleeve is raised to the lower dotted line position of FIG. 1 and pin 41 inserted in the bottom-most opening 12 in post 11. At this point, the hydraulic cylinder or air piston is engaged by bracket 27 with lug 19 with pin 28 inserted through openings in both. Slide 36 is inserted in the uppermost slideway between member 31 and 32 with lug 37 extending over the base plate and lug 19. Bracket 26 is moved so as to receive lug 37 between the legs thereof and pin 38 inserted for positive engagement. At this point, preferably with the other slide 35 in the lower slideway, the device is ready to work and will lift within the dotted line range of showings in FIG. 1. There are four openings 12 in post 11 which, once the work is lifted therepast, may be engaged by pin 41, or a second like pin, to support the work in an elevated position once the primary lift is made.

When it is desired that the maximum lift of sleeve 13 with respect to post 11 be had with the device being described, the same assembly procedure is employed for the parts, but sleeve 13 is initially raised to the full line position of FIG. 1 and pin 41 preferably engaged thereunder before slide 36 is put into the lower slideway, as seen in FIGS. 1 and 2, and slide 35 inserted in the upper slideway. At this point, the hydraulic cylinder or air piston 20 may be used to lift slide 13 between the lowermost position seen in full lines in FIG. 1 and the uppermost opening 12 therein. Again, one or more pins 41 may be employed to hold the sleeve 13 at any desired position of lift with respect to post 11. On removal of the pin from its support position and release of the hydraulic pressure from cylinder 20, the device will return to its lower position, in either case, either the full line showing of FIG. 1 or the lowermost dotted line showing of FIG. 1, depending upon the starting level. A pin 41 may be left there to ensure the end level upon release of the hydraulic pressure from cylinder 20.

Thus there has been provided an extremely rugged lifting jack which is able to provide maximum versatility in that the full throw of the hydraulic cylinder or air piston may be employed starting from a lower or a higher position with respect to the base plate 10 or guiding post 11. It is feasible under certain circumstances to have three instead of two slideways, depending upon the throw of the cylinder or piston 20, the height of post 11, etc. The key to such three slideway use is that there must be a sufficient height of post within the sleeve to stabilize the sleeve on the post against lateral forces. Typically, as shown, a two slideway system is optimal. If there is more than two slideways, when one of the lower slideways is being employed, the uppermost slideway or slideways should be filled with slides for maximum strength. The slides 35 and 36 preferably have a sliding, but friction fit in the slideways.

In the event of use of an hydraulic cylinder, preferably a tractor is available to provide the hydraulic system and power. Alternatively, when a tractor is not available to provide the power, a standard hydraulic cylinder hand pump may be used by the operator. This typically is a single action cylinder. Typical and optimal uses of the device are in farm and commercial use. The two grease fittings 14 are preferably 180° opposed to one another, one spaced downwardly from the top of sleeve 13, the other spaced upwardly from the bottom thereof, preferably positioned on the side edges of the sleeve.

It should be understood that the jack construction here disclosed and described may be made of various dimensions, depending upon use requirements and need. However, a typical set of dimensions for a useful farm jack of this type is as follows. Base plate 10 could be 12 inches long and 7 inches wide. The distance from the adjacent side of post 11 to the center of the hole in lug plate 19 receiving pin 28 could be 3½ inches. The height of post 11 could be 22¾ inches, the post 3 inches on each side, if square. Sleeve 13 in such case would typically be 23 inches deep under top plate 15 and 3½ inches on a side. The height of insert plates 35 and 36 could be 5 inches. With these typical dimensions, and employing a conventional farm hydraulic cylinder having an 8 inch throw or thrust cylinder, the subject device may be so constructed that it has the two options of, first, an 8 inch thrust when the piston rod 25 is engaged with plate 36 in the position of FIG. 4 and, secondly, a 14 inch throw of the sleeve when piston rod 25 is connected to plate 36 and the latter is positioned in the lower slideway as in FIGS. 1–3, inclusive.

From the foregoing, it will be seen that this invention is one well adapted to attain all of the ends and objects hereinabove set forth together with other advangates which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. A jack construction comprising, in combination, a substantially rectangular base plate, an elongate post of rectangular cross-section fixed at one end thereof to the base plate and extending substantially normal thereto, an elongate sleeve of rectangular cross-section congruent to the cross-sectional shape of the post having one open end and one closed end mounted on and movable along and with respect to said post, the length of the sleeve substantially that of the post, the closed end of the sleeve positioned away from the base plate, there being a flat end plate closing the end of said sleeve which is adapted to receive work loads thereon, first lug means on the base plate adjacent to one side of the post which is adapted to receive and engage one end of a hydraulic cylinder, the said end plate of the sleeve having an extending, substantially rectangular lip projecting outwardly past the wall of the sleeve next the side of the post adjacent to said lug means, means on the upper portion of the sleeve and on the side thereof next to the said first lug means forming a pair of horizontal slideways of a size and configuration equal to one another, said slideways positioned one above the other and below said lip, two slides removably insertable in the said slideways, one slide into each slideway, one of said slides having second lug means thereon for engagement with the piston rod of the hydraulic cylinder, and means cooperating between the post and the sleeve for fixing an extended position of the sleeve with respect to the post once the sleeve is extended thereon by action of the hydraulic cylinder.

2. A jack construction as in claim 1 including a foot fixed to the sleeve on the side thereof opposite the side carrying the means forming the slideways, said foot positioned substantially adjacent the lower end of the sleeve and extending substantially parallel to the base plate.

3. A jack construction as in claim 1, wherein the means cooperating between the post and the sleeve for fixing the extended position of the sleeve with respect to the post, once the sleeve is extended thereon, comprises:

a series of openings through the post in a direction substantially normal to a line connecting the center of the post and the first lug means and a pin removably insertable through one of said openings of greater length than the thickness of the post in the direction of the openings, whereby the bottom of the sleeve may rest thereon, once the sleeve has been extended on the post past said one opening and the pin is inserted therein through the post.

4. A jack construction as in claim 1 including one or more grease input fittings positioned on the said sleeve and operative to feed grease into the annulus between the sleeve and the post.

5. A jack construction as in claim 1 wherein the cross-sectional shape of the post and the sleeve are both square.

6. A jack construction as in claim 1 wherein the slideway construction comprises an uppermost L shaped member with the short leg of the L opening downwardly, with the slide end plate being the long leg of the L, a T shaped member centrally defining the lower wall of the upper slideway and the upper wall of the lower slideway and a second L shaped member therebelow forming the lower wall of the lower slideway, all of said L and T shaped members fixably attached to the sleeve and configured as described in side view, there being stop means at one and the same end of each said slideway, the other end of each said slideway open for insertion and removal of the slides therein.

7. A jack construction as in claim 1 wherein the first member is hollow.

* * * * *